US006263775B1

(12) United States Patent
Vössing et al.

(10) Patent No.: US 6,263,775 B1
(45) Date of Patent: Jul. 24, 2001

(54) ROTARY KNIFE CARRIER FOR USE IN CROSS CUTTERS

(75) Inventors: Dirk Vössing, Hamburg; Wolfram Szczepaniak, Stelle, both of (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 09/253,796

(22) Filed: Feb. 22, 1999

(30) Foreign Application Priority Data

Feb. 20, 1998 (DE) ..... 198 07 111

(51) Int. Cl.[7] ..... B26D 1/40; B26D 7/26
(52) U.S. Cl. ..... 83/698.51; 83/345; 83/674
(58) Field of Search ..... 83/698.51, 698.41, 83/331, 345, 674, 305

(56) References Cited

U.S. PATENT DOCUMENTS

| | | | | |
|---|---|---|---|---|
| 3,030,841 | * | 4/1962 | Haas | 83/698.51 X |
| 3,709,077 | * | 1/1973 | Trogan et al. | 83/698.51 X |
| 3,822,625 | * | 7/1974 | Obenshain | 83/698.51 X |
| 3,865,164 | | 2/1975 | Sybertz . | |
| 3,957,094 | * | 5/1976 | Maier | 144/230 |
| 4,068,694 | * | 1/1978 | Schmidt et al. | 144/230 |
| 4,159,661 | | 7/1979 | Russell et al. . | |
| 4,467,687 | * | 8/1984 | Fokos et al. | 83/698.51 X |
| 5,348,065 | | 9/1994 | Meyer . | |

FOREIGN PATENT DOCUMENTS

| | | | | |
|---|---|---|---|---|
| 2522564 | * | 9/1976 | (DE) | 83/698.51 |
| 92 13 466 | | 2/1993 | (DE) . | |
| 295 12 032 | | 11/1995 | (DE) . | |
| 1 509 824 | | 5/1978 | (GB) . | |

OTHER PUBLICATIONS

Patent Abstracts of Japan, Publication No. 08099292, published published 16, 1996.

Patent Abstracts of Japan, Publication No. 08099291, published Apr. 16, 1996.

* cited by examiner

*Primary Examiner*—Boyer D. Ashley
(74) *Attorney, Agent, or Firm*—Venable; George H. Spencer; Robert Kinberg

(57) ABSTRACT

One rotary knife carrier of a pair of carriers in a cross cutter for running webs of paper, cardboard or the like has longitudinally extending peripheral recesses for disposable elongated strip-shaped knives each of which has a first lateral surface abutting and slidable along a supporting surface of the carrier in the respective recess, and a second lateral surface contacted by a retaining surface of an elongated clamping member which is urged against the second lateral surface by the head(s) of one or more tensioning bolts having shanks extending with clearance through openings in the clamping member and into tapped bores in the carrier. The clamping member is in form-locking frictional and/or mechanical engagement with the knife and is shiftable relative to the carrier to adjust the knife, e.g., to compensate for wear upon the cutting edge and/or to carry out adjustments relative to a complementary knife on the other carrier, against the resistance of or upon loosening of the tensioning bolt(s), preferably by one or more threaded fasteners carried by the holder and abutting an end face of the clamping member.

3 Claims, 3 Drawing Sheets

ROTARY KNIFE CARRIER FOR USE IN CROSS CUTTERS

CROSS-REFERENCE TO RELATES CASES

This application claims the priority of German patent application Serial No. 198 07 111.6 filed Feb. 20, 1998. The disclosure of the German patent application, as well as that of each patent mentioned in the specification of the present application, is incorporated herein by reference.

BACKGROUND OF THE INVENTION

The invention relates to improvements in cross cutters for running webs of paper, cardboard, metallic foil, plastic foil or the like, and more particularly to improvements in rotary knife holders or knife carriers which are utilized in such apparatus.

It is known to provide the rotary knife carriers of cross cutters for running webs of paper or the like with longitudinally extending peripheral recesses for elongated knives. Successive knives on one of the carriers (at one side of the path for the running web) cooperate with successive knives on the other carrier (at the other side of the path for the running web), not unlike the blades of shears or scissors, to sever the moving web in such a way that the cut is started at one marginal portion and proceeds transversely of and toward the other marginal portion of the running web. The selected planes of the knives in the respective recesses are or can be such that the cutting edges of the knives project from the respective recesses and that the knives are parallel or nearly parallel to imaginary tangents to the peripheral surfaces of the respective (normally cylindrical) carriers.

It is also known to employ readily detachable knives which are clamped against the respective carriers, namely against portions of surfaces bounding the respective recesses in the rotary drum-shaped carriers, and it is equally known to adjustably secure at least some knives to their carriers so that the knives on one of the carriers can be properly positioned relative to the complementary knives on the other carrier and/or that the knives can be adjusted in order to compensate for wear at and to sharpen the cutting edges. Reference may be had, for example, to German Petty Patent (Utility Model) No. 295 12 032.

The making of transverse cuts which begin at one marginal portion and proceed toward the other marginal portion of the running web is achieved by employing knives having a slightly helical shape. An important prerequisite for the making of clean cuts is that the pairs of cooperating knives on the two rotary carriers be properly adjusted relative to each other so that their cutting edges slide, without play, relative to each other in a manner known from the blades of shears, scissors or analogous cutting implements.

OBJECTS OF THE INVENTION

An object of the invention is to provide a novel and improved cross cutter for running webs or strips of paper, cardboard or the like.

Another object of the invention is to provide a novel and improved rotary carrier for use in a cross cutter.

A further object of the invention is to provide the carrier with novel and improved means for adjustably, accurately and reliably securing one or more knives to the rotary carriers in cross cutters for webs of paper or the like.

An additional object of the invention is to provide a novel and improved adjustable mounting for one or more knives on the rotary carriers of cross cutters for running webs of paper or the like.

Still another object of the invention is to provide novel and improved means for separably and adjustably securing knives to the rotary knife carriers of cross cutters for paper or the like.

A further object of the invention is to provide rotary carriers which can reliably support and permit accurate adjustments of simple and inexpensive (such as throw-away) knives adapted to be mounted in longitudinally extending peripheral recesses of their carriers.

Another object of the invention is to provide a novel and improved carrier-knife combination wherein all parts are readily accessible and (if necessary) removable or replaceable with little loss in time.

An additional object of the invention is to provide lightweight and inexpensive but long-lasting carriers which can be utilized in various types of cross cutters for running webs or strips of paper or the like.

Still another object of the invention is to provide a novel and improved arrangement of clamping, tensioning and adjusting means for the knives which are utilized in rotary carriers of cross cutters for running webs of paper or the like.

A further object of the invention is to provide a novel and improved method of installing, securing and adjusting knives in, to and relative to rotary carriers of cross cutters for running webs of paper or the like.

SUMMARY OF THE INVENTION

The invention is embodied in a cross cutter for running webs of paper, cardboard or the like. The improved cross cutter comprises a carrier (e.g., an elongated shaft or drum or cylinder) which is rotatable about a predetermined axis and is provided with a recess extending at least substantially in the direction of the axis. The carrier has a supporting surface which bounds a portion of the recess, and the cross cutter further comprises an elongated knife having a first lateral surface abutting the supporting surface in the recess and a second lateral surface which is or can be parallel to the first lateral surface. The cross cutter further comprises an elongated (one-piece or composite) clamping member which is at least partially received in the recess and has a retaining surface abutting the second lateral surface, at least one tensioning member which is affixed to the carrier and serves to urge the clamping member against the second lateral surface, and at least one adjusting member for the clamping member. The adjusting member is mounted on the carrier and is actuatable to move the clamping member and the knife transversely of the axis of the carrier. This causes the first lateral surface of the knife to slide along the supporting surface in the recess of the carrier.

The cross cutter further comprises a form-locking (e.g., mechanical and/or frictional) connection which is provided between the second lateral surface of the knife and the retaining surface of the clamping member (and/or elsewhere between the knife and the clamping member) and serves to compel the knife to share the movements of the clamping member under the action of the at least one adjusting member.

The carrier can further comprise a guide surface which bounds a further portion of the recess and includes a portion spaced apart from the knife. The clamping member of such cross cutter can have a contact surface which abuts the guide surface under the urging of the at least one tensioning member, and such contact surface is arranged to slide along the guide surface of the carrier in response to actuation of the at least one adjusting member. If the peripheral surface of the carrier is an at least substantially cylindrical surface, the guide surface in the aforesaid recess can extend substantially tangentially of the peripheral surface (and more particularly in substantial parallelism with an imaginary tangent to the peripheral surface).

The at least one tensioning member can include a threaded fastener extending through the clamping member in such orientation that its axis is at least substantially normal to the guide surface of the carrier. Te axis of the threaded fastener can extend at least substantially radially of the axis of the fastener. The at least one adjusting member can include a threaded fastener having an axis which is at least substantially normal to the axis of the threaded fastener forming part of or constituting the at least one tensioning member.

The supporting surface and the guide surface of the carrier make an oblique angle, e.g., an angle of close to but less than 180°. At least the first lateral surface of the knife can be at least substantially parallel to the supporting surface in the recess of the carrier.

The aforementioned form-locking connection between the clamping member and the knife can comprise a projection extending from the second lateral surface of the knife or from the adjacent retaining surface of the clamping member and into a socket provided in the retaining surface of the clamping member or in the second lateral surface of the knife. The projection can include an elongated rib provided on the retaining surface of the clamping member in at least substantial parallelism with the axis of the carrier, and the socket can comprise an elongated groove provided in the second lateral surface of the knife.

Alternatively, the form-locking connection between the knife and the clamping member can comprise an elongated edge face which is provided on the knife and extends in parallelism or substantial parallelism with the axis of the carrier, and a shoulder provided on the clamping member and abutting the edge face. The edge face and the shoulder of the just described form-locking connection can be remote from the elongated cutting edge of the knife and can be at least substantially normal to the supporting surface of the carrier.

The two lateral surfaces of the knife are or can be closely adjacent to and can be at least substantially parallel with each other. The knife is or can be deformable so that it can be readily caused to follow the outline of the supporting surface in the recess of the carrier. Furthermore, the knife can be of the dispensable (throw-away) type.

At least a portion of the carrier can consist of a plastic material, and such portion can be reinforced, e.g., by carbon fibers. A plastic or at least partially plastic carrier can comprise at least one substantially plate-like insert which is at least partially embedded in the plastic portion of the carrier, and at least a portion of the aforementioned supporting and/or guide surface in the recess of the carrier can be provided on the insert (such insert can be made of wear-resistant metallic sheet or plate material).

The novel features which are considered as characteristic of the invention are set forth in particular in the appended claims. The improved cross cutter itself, however, both as to its construction and the modes of assembling and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
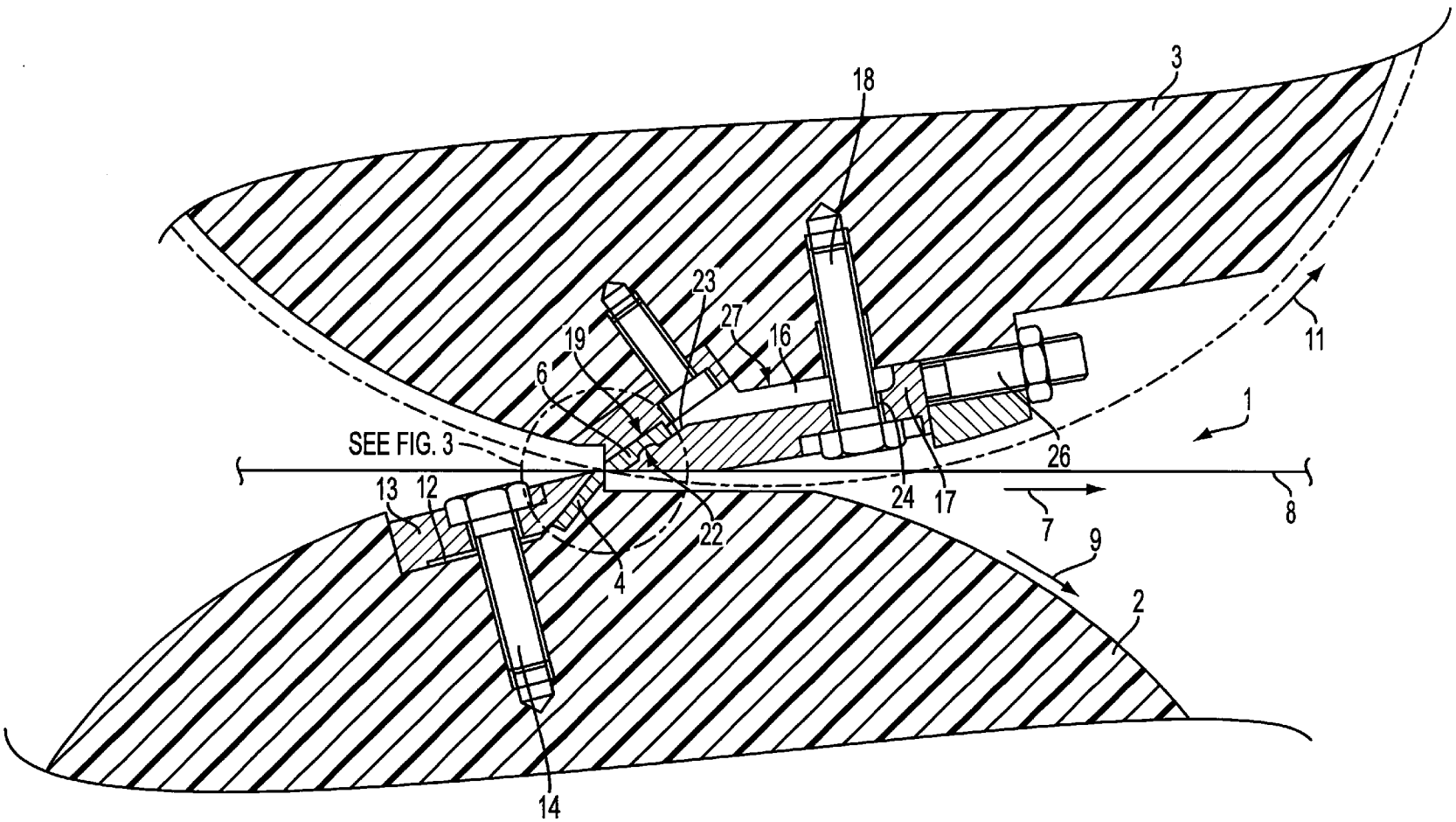
FIG. 1 is a fragmentary transverse sectional view of a cross cutter wherein one of the rotary carriers is constructed and cooperates with a knife, a knife clamping device, knife tensioning means and knife adjusting means in accordance with one embodiment of the instant invention.
Figure 3:
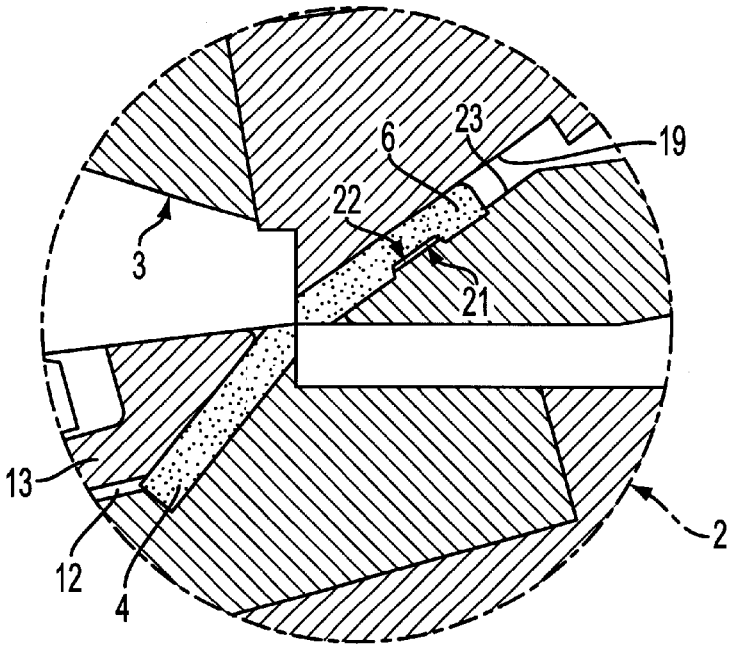
FIG. 3 is an enlarged view of a detail within the dot-dash line circle X in FIG. 1.

FIGS. 1 and 3 show portions of two cooperating elongated at least substantially cylindrical rotary knife carriers or holders 2, 3 forming part of a cross cutter 1 for webs or strips 8 of paper, cardboard, plastic foil, metallic foil or the like. The carriers 2, 3 are driven to rotate in directions respectively indicated by the arrows 9, 11, and the web 8 is advanced in the direction indicated by the arrow 7.

The carrier 2 has several substantially axially parallel peripheral recesses or pockets 12 (only one can be seen in FIGS. 1 and 3) for discrete elongated strip-shaped metallic knives 4. One lateral surface of the illustrated knife 4 is urged against an adjacent portion of the surface bounding the recess 12 by a one-piece elongated clamping member 13 (or by a composite clamping member composed of two or more sections disposed end-to-end in the axial direction of the carrier 2, i.e., at right angles to the plane of FIG. 1 or 3) which is separably secured to the carrier 2 by a set of threaded tensioning and fastening members or bolts 14. Each bolt 14 (only one is shown in FIG. 1) has an elongated shank extending through a hole in the clamping member 13 and into a tapped bore or hole in the carrier 2. The axis of the bolt 14 extends substantially radially of the axis of the carrier 2. The clamping member 13 has a surface which bears upon the adjacent outer lateral surface of the knife 4 and urges the other (inner) lateral surface of such knife against the adjacent supporting surface in the recess 12. The knife 4 may but need not always be adjustable relative to the carrier 2, and its cutting edge is shown in the process of severing the running web 8. The knife 4 is a thin elongated strip of suitable metallic material.

The carrier 3 also comprises several axially parallel or substantially axially parallel recesses or pockets 16 (one shown in each of FIGS. 1 and 3) each of which extends transversely of the plane of FIG. 1 or 3, and each such recess receives an elongated strip-shaped knife or cutter 6 which is installed, clamped, tensioned and adjustable in accordance with a feature of the present invention.

The cutting edge of each knife 6 cooperates with the cutting edge of one of the knives 4 to sever the running web 8 while the latter advances in the direction of arrow 7 and while the carriers 2, 3 are driven to respectively rotate in directions indicated by the arrows 9, 11. The plane of the knife 6 makes an acute angle with a plane which is tangential to the adjacent portion of the peripheral surface of the carrier 3 (the same holds true for the knife 4 and the adjacent plane which extends tangentially of the peripheral surface of the carrier 2).

The means for adjustably securing the knife 6 in the respective recess 16 of the carrier 4 comprises an elongated clamping member 17 which can be of one piece or can be assembled of several sections arranged end-to-end and extending substantially at right angles to the plane of FIG. 1 or 3. The illustrated clamping member 17 has a retaining surface 23 which bears upon the adjacent lateral surface of the knife 6 and urges the other lateral surface of the knife 6 against the adjacent supporting surface 19 bounding a portion of the recess 16. Actually, the supporting surface 19 is provided on an elongated strip-shaped or similar (bar-shaped) metallic member which is recessed into a portion of the surface bounding the recess 16 and is affixed to the carrier 4 by a set of bolts one of which is shown in FIG. 1. The upper lateral surface of the knife 6 (as viewed in FIGS. 1 and 3) abuts against but is slidable relative to the supporting surface 19 of the just discussed elongated metallic member defining a portion of the recess or pocket 16. Such sliding movements of the knife 6 relative to the supporting surface 19 are necessary in order to adjust the cutting edge of the knife 6 relative to the cutting edge of the cooperating knife 4.

The knife 6 is form-lockingly connected with the clamping member 17 in such a way that it shares all movements of the member 17 relative to the carrier 4. To this end, the retaining surface 23 of the clamping member 17 is provided with an extension 22 in the form of an elongated rib which is received in a socket 21 (namely a longitudinally extending groove) in the adjacent lateral surface of the knife 6. It is also possible to establish a purely frictional form-locking connection between the knife 6 and the adjacent portion of the clamping member 17, or to utilize the frictional form-locking connection in addition to the aforedescribed mechanical connection 21, 22.

A portion of the recess 16 in the carrier 4 is bounded by a guide surface 27 which makes an oblique angle with the retaining surface 23 and abuts a surface at the rear portion of the clamping member 17, namely a portion which is remote from the knife 6. The clamping member 17 is urged against the guide surface 27 by a set of tensioning members 18 in the form of bolts having axes extending at least substantially at right angles to the guide surface 27 and radially of the axis of rotation of the carrier 4. The shanks of the bolts 18 extend with clearance through openings 24 provided in the clamping member 17, and the heads of such bolts abut the exposed side of the member 17. When the bolts 18 are tightened, the member 17 bears against the guide surface 27 and the form-locking connection 21, 22 causes the knife 6 to share the movement of the member 17 and to slide relative to the supporting surface 19.

The means for adjusting the clamping member 17 and the knife 6 relative to the carrier 3 (i.e., relative to the knife 4 and the carrier 2) comprises a set of bolts and nuts 26. The bolts mate with the adjacent portion of the carrier 3 and can shift the clamping member 17 along the guide surface 27 to the extent determined by the extent of clearance between the surfaces bounding the openings 24 and the shanks of the bolts 18. The guide surface 27 is at least substantially parallel to an imaginary surface extending tangentially of the adjacent portion of the peripheral surface of the carrier 3.

Though it is possible to loosen (somewhat) the bolts 18 prior to adjustment of the clamping member 17 and knife 6 relative to the carriers 2, 3 and knife 4 (by adjusting means 26), the knife 6 can be mass-produced as a disposable (throw-away) tool which is sufficiently elastic to enable the adjusting means to change the position and the configuration of the knife 6 while the bolts 18 are caused to urge the rear portion of the clamping member 17 against the guide surface 27 and to simultaneously urge the retaining surface 23 on the wedge-shaped front portion of the member 17 against the adjacent lateral surface of the knife 6 (which causes the other lateral surface of this knife to bear against the supporting surface 19).

Figure 4:
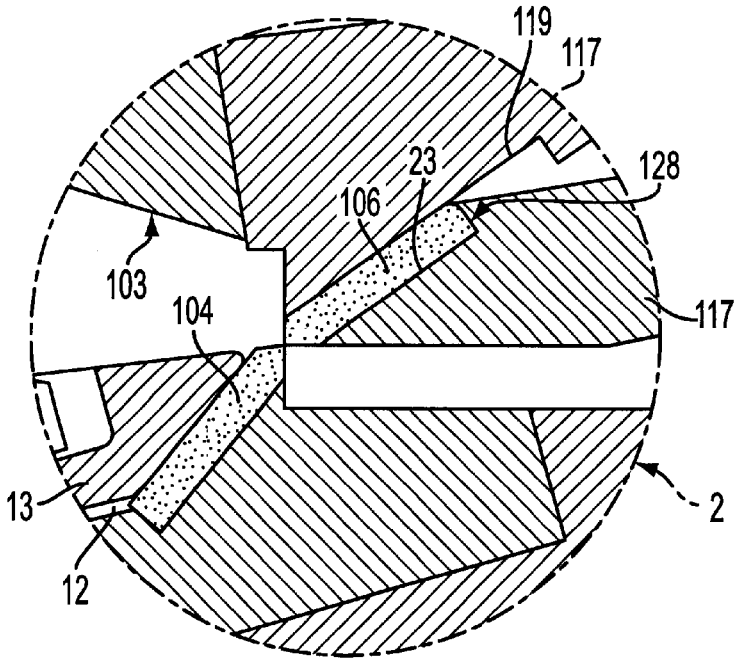
FIG. 4 is a similar enlarged view of a detail in a third cross cutter.

All such parts of the modified cross cutter shown in FIG. 4 which are identical with or clearly analogous to the corresponding parts of the cross cutter 1 shown in FIGS. 1 and 3 are denoted by similar reference characters. The main difference between the structure of FIGS. 1–2 and the structure of FIG. 4 is that the form-locking connection between the knife 106 and the clamping member 117 comprises an elongated rear edge face provided on the knife 106 and facing away from the latter's cutting edge, and a shoulder 128 provided on the clamping member 117 and bearing upon the edge face. The edge face of the knife 106 is or can be at least substantially parallel to the rotational axis of the carrier 103. The shoulder 128 and the edge face of the knife 106 are or can be at least substantially normal to the supporting surface 119. The manner in which the clamping member 117 is tightened against and is adjustable relative to the carrier 103 is or can be the same as described with reference to the clamping member 17 of FIGS. 1 and 3.

Figure 2:
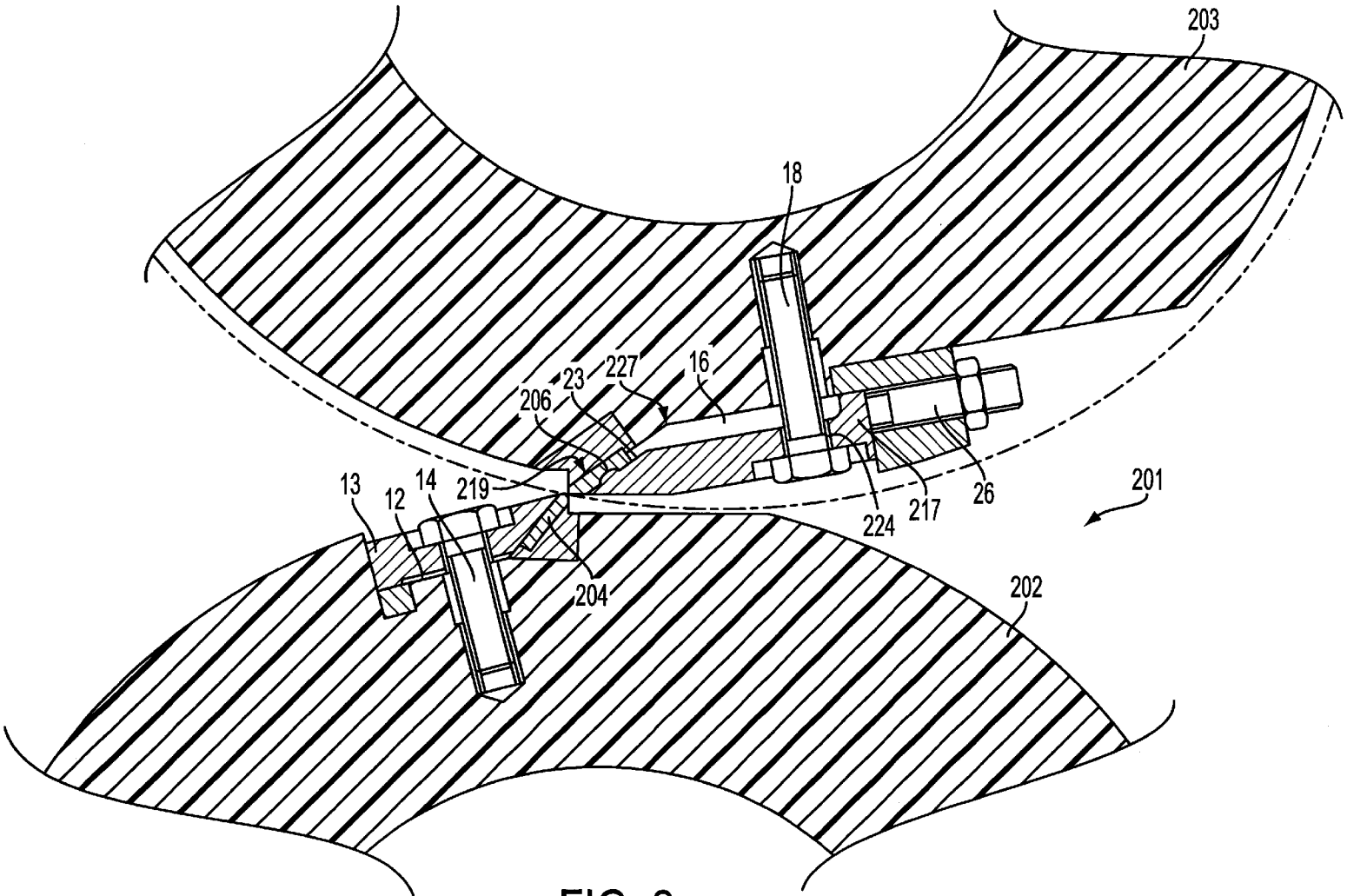
FIG. 2 is a similar fragmentary transverse sectional view of a modified cross cutter.

FIG. 2 shows a portion of a third cross cutter 201. All such parts of this cross cutter which are identical with or clearly analogous to the corresponding parts of the cross cutter 1 of FIGS. 1 and 3 are denoted by the same reference characters. At least one of the carriers or holders 202, 203 is made, at least in part, of a suitable synthetic plastic material. Such plastic material can be any material which exhibits the required stabiliy and other desirable characteristics. The plastic material of the carrier 202 and/or 203 can be reinforced by carbon fibers and/or in any other suitable way.

It is often preferred to provide the carriers 202, 203 with reinforcing inserts in the form of metallic plates, sheets or the like. Those surfaces which are subject to extensive or maximum wear and/or pressures in actual use of the improved cross cutter 201 can be provided on such metallic insert or inserts. For example, the guide surface 227 for the clamping member 217 is provided on a metallic insert which is embedded into and/or is otherwise reliably secured (e.g., bonded) to the plastic carrier 203. The same holds true for the supporting surface 219. In all other respects, the cross cutter 201 can be identical with the cross cutter 1 of FIGS. 1 and 3.

An advantage of the cross cutter 201 is that the weight of the carriers 202, 203 can be much less than that of the carriers 2, 3.

An advantage shared by all embodiments of the improved cross cutter is that it can employ lightweight and inexpensive (disposable) knives or cutters, that the elasticity of the readily deformable knives renders it possible to adjust the knife 6, 106 or 206 relative to the complementary knife 4, 104 or 204 with a high degree of accuracy and that the selected configuration enables the clamping members 17, 117, 217 to act upon the respective knives 6, 106, 206 in cantilever fashion to thus ensure reliable retention of the knives in selected positions but to permit all necessary adjustments of the knives 6, 106 and 206 relative to the complementary knives 4, 104, 204. Furthermore, the knives are in large-area contact with the respective carriers as well as with the respective clamping members; this also contributes to strong and reliable retention of adjustable knives in the selected positions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of cross cutters for running paper webs and the like and, therefore, such adaptations should and are intended to be comprehended within the meaning and range of equivalence of the appended claims.

What is claimed is:

1. A cross cutter for running webs of material, comprising:

a carrier rotatable about a predetermined axis and having a peripheral surface provided with a recess extending at least substantially parallel to said axis, said carrier further having a supporting surface bounding a portion of said recess;

an elongated knife having a first lateral surface abutting and slidable along said supporting surface, and a second lateral surface;

an elongated clamping member at least partially received in said recess and having a retaining surface abutting said second lateral surface;

at least one tensioning member affixed to said carrier and arranged to urge said clamping member against said second lateral surface;

at least one adjusting member mounted on said carrier that acts on said clamping member and moves said clamping member and said knife transversely to said axis to adjust a position of said knife; and a form-locking connection provided between said knife and said clamping member and arranged to compel said knife to move together with said clamping member when the clamping member is moved by said at least one adjusting member, wherein said form-locking connection includes an elongated edge face provided on said knife and extending in at least substantially parallelism with said axis, and a shoulder provided on said clamping member and abutting said edge face.

2. The cross cutter of claim 1, wherein said edge face and said shoulder are remote from an elongated cutting edge of said knife and are at least substantially normal to said supporting surface.

3. The cross cutter of claim 1, wherein said knife is disposable.

* * * * *